US009077079B2

(12) United States Patent
Ke et al.

(10) Patent No.: US 9,077,079 B2
(45) Date of Patent: Jul. 7, 2015

(54) ELECTRONIC DEVICE

(71) Applicants: Yun-Lung Ke, Taipei (TW); Wen-Feng Tsai, Taipei (TW); Cheng-Chi Chen, Taipei (TW); Huang-Wei Chen, Taipei (TW)

(72) Inventors: Yun-Lung Ke, Taipei (TW); Wen-Feng Tsai, Taipei (TW); Cheng-Chi Chen, Taipei (TW); Huang-Wei Chen, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 165 days.

(21) Appl. No.: 13/633,141

(22) Filed: Oct. 2, 2012

(65) Prior Publication Data

US 2014/0062797 A1 Mar. 6, 2014

(30) Foreign Application Priority Data

Aug. 28, 2012 (TW) ..... 101131227 A

(51) Int. Cl.

| | |
|---|---|
| ***H01Q 1/24*** | (2006.01) |
| ***H01Q 1/38*** | (2006.01) |
| ***H01Q 1/52*** | (2006.01) |
| *H01Q 1/22* | (2006.01) |
| *H01Q 21/28* | (2006.01) |

(52) U.S. Cl.

CPC ..... *H01Q 1/521* (2013.01); *H01Q 1/2266* (2013.01); *H01Q 21/28* (2013.01)

(58) Field of Classification Search

USPC ..... 343/702, 700 MS

See application file for complete search history.

(56) References Cited

U.S. PATENT DOCUMENTS

| | | | | |
|---|---|---|---|---|
| 6,011,519 | A * | 1/2000 | Sadler et al. | 343/742 |
| 6,812,892 | B2 * | 11/2004 | Tai et al. | 343/700 MS |
| 2007/0069960 | A1 * | 3/2007 | Moon et al. | 343/700 MS |

* cited by examiner

*Primary Examiner* — Graham Smith

(74) *Attorney, Agent, or Firm* — Jianq Chyun IP Office

(57) ABSTRACT

An electronic device including a shell, an antenna unit, an insulating layer and an isolating conductor is provided. The material of the shell includes conductive material. The antenna unit is disposed on the shell and includes a first antenna and a second antenna. The first antenna and the second antenna are grounded to the shell. The insulating layer is disposed on the shell and located between a ground plane of the first antenna and a ground plane of the second antenna. The isolating conductor is disposed on the insulating layer and has a slot.

7 Claims, 1 Drawing Sheet

ELECTRONIC DEVICE

CROSS-REFERENCE TO RELATED APPLICATION

This application claims the priority benefit of Taiwan application serial no. 101131227, filed on Aug. 28, 2012. The entirety of the above-mentioned patent application is hereby incorporated by reference herein and made a part of this specification.

BACKGROUND OF THE INVENTION

1. Field of the Invention

The invention relates to an electronic device, and more particularly to an electronic device with an antenna.

2. Description of Related Art

Due to the increasing demands to the quality, reliability, and speed of transmission of wireless communication signal, some multiple-antenna systems have been developed, such as the technological developments of the pattern switchable or beam-steering antenna system or the multi-input multi-output (MIMO) antenna system. For example, the current MIMO antenna technology (IEEE 802.11n) at the frequency band (2400-2484 MHz, 84 MHz) of the wireless local area network (WLAN) system has been successfully employed in products such as notebook computers, hand-held communication devices, or wireless access points. In the conventional design of notebook computers, a MIMO antenna system is configured at an upper part of the display screen, and the display screen is formed of a non-metallic material, such that the two antennas are kept in a distance to meet the need of high isolation and avoid the mutual interference between the two antennas having an identical resonate frequency.

However, with the tendency to be lightweight, slim, and small, the MIMO antennas of some notebook computers have been disposed in a closer and closer distance in recent years. Consequently, signals of two antennas having the same resonate frequency band interfere mutually since the two antennas are too close to each other. Accordingly, with the limitations, how to increase the isolation between the two antennas has become an important issue.

SUMMARY OF THE INVENTION

The invention provides an electronic device that allows an antenna unit of the electronic device to meet the need of high isolation.

The invention provides an electronic device, including a shell, an antenna unit, an insulating layer, and an isolating conductor. A material of the shell includes a conductive material. The antenna unit is disposed on the shell and includes a first antenna and a second antenna. The first antenna and the second antenna are grounded to the shell. The insulating layer is disposed on the shell and located between a ground plane of the first antenna and a ground plane of the second antenna. The isolating conductor is disposed on the insulating layer and has a slot.

In an embodiment of the invention, the first antenna and the second antenna have the same resonate frequency.

In an embodiment of the invention, a length of the slot is 0.5 times longer than a wavelength of the resonate frequency of the first antenna and the second antenna.

In an embodiment of the invention, a length of the slot is 0.25 times longer than a wavelength of the resonate frequency of the first antenna and the second antenna.

In an embodiment of the invention, a material of the insulating layer includes plastic.

In an embodiment of the invention, the shell is an appearance part of the electronic device.

In an embodiment of the invention, the insulating layer is located between the shell and the isolating conductor so that the shell and the isolating conductor have a distance in between and are equivalent to a capacitor.

In an embodiment of the invention, the slot is in a bending shape.

In an embodiment of the invention, a material of the conductive material includes metal or carbon fiber.

Based on the above, the insulating layer of the invention is disposed on the shell and is located between the ground plane of the first antenna and the ground plane of the second antenna. Moreover, the isolating conductor is disposed on the insulating layer and has the slot. The slot can be designed to have an appropriate length so as to coincide with the resonate frequency of the first antenna and the second antenna. As a result, even if the shell serves as a mutual ground plane for the first antenna and the second antenna to conduct the first antenna and the second antenna, the signals of the first antenna and the second antenna are isolated from each other via the isolating conductor and the slot thereon and do not interfere mutually with the conduction of the shell, so that the antenna unit meets the need of high isolation.

In order to make the aforementioned features and advantages of the invention more comprehensible, embodiments accompanying figures are described in detail below.

DESCRIPTION OF EMBODIMENTS

Figure 1:
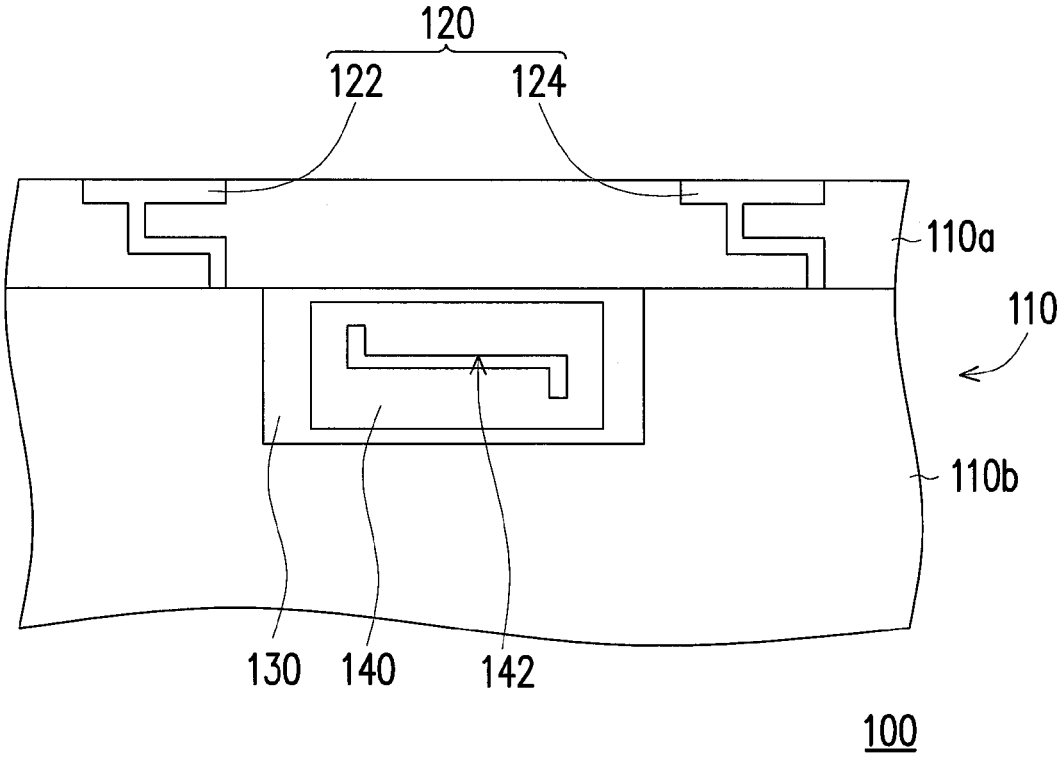
FIG. 1 is a local schematic view of an electronic device in an embodiment of the invention.

FIG. 1 is a local schematic view of an electronic device in an embodiment of the invention. Please refer to FIG. 1. An electronic device 100 in the embodiment is, for example, a notebook computer, including a casing 110, an antenna unit 120, an insulating layer 130, and an isolating conductor 140. The casing 110 is, for example, a case for a base of the notebook computer, including a shell 110*a* and a shell 110*b*. A material of the shell 110*b* is a conductive material such as metal or carbon fiber. The antenna unit 120 is disposed on the shell 110*b* and includes a first antenna 122 and a second antenna 124. The first antenna 122 and the second antenna 124 are grounded to the shell 110*b*. The insulating layer 130 is disposed on the shell 110*b* and is located between a ground plane of the first antenna 122 and a ground plane of the second antenna 124. The isolating conductor 140 is disposed on the insulating layer 130 and has a slot 142.

In the embodiment, a resonate frequency of the first antenna 122 and a resonate frequency of the second antenna 124 are, for example, identical. The slot 142 of the isolating conductor 140 can be designed to have an appropriate length to concise with the resonate frequency of the first antenna 122 and the second antenna 124. As a result, even if the shell 110*b* serves as a mutual ground plane for the first antenna 122 and the second antenna 124 to conduct the first antenna 122 and the second antenna 124, signals of the first antenna 122 and the second antenna 124 generate a coupling electric field via the insulating layer 130 and the slot 142 on the isolating conductor 140 to consume the current on the mutual ground plane, so that the antenna unit 120 meets the need of high isolation.

To be specific, a length of the slot 142 of the isolating conductor 140 is, for example, 0.5 times longer than a wavelength of the resonate frequency of the first antenna 122 and the second antenna 124. In other embodiments, the length of the slot 142 of the isolating conductor 140 may be 0.25 times longer than the wavelength of the resonate frequency of the first antenna 122 and the second antenna 124 or may be other appropriate lengths so as to coincide with the resonate frequency of the first antenna 122 and the second antenna 124. The invention is not limited thereto. In addition, the slot 142 can be designed to be in a bending shape as shown in FIG. 1 so as to have an adequate length to coincide with the resonate frequency when a disposition space is limited. In other embodiments, the slot 142 may be in an L shape, a T shape, or other appropriate shapes. The invention is not limited thereto.

In the embodiment, the shell 110*b* is, for example, a casing of the electronic device 100 and is an appearance part. Under the circumstances where the shell 110*b* is the appearance part, if the slot 142 is formed in the shell 110*b*, an appearance of the electronic device 100 will be affected and an inner space of the electronic device 100 will be exposed. Taking that into consideration, in the embodiment, the insulating layer 130 is disposed on the shell 110*b*, and the isolating conductor 140 is disposed on the insulating layer 130. Moreover, the slot 142 is formed in the isolating conductor 140 so as to avoid affecting the appearance of the electronic device 100 with the disposition of the slot 142.

A material of the insulating layer 130 in the embodiment is, for example, plastic. In other embodiments, the material of the insulating layer 130 may be other appropriate non-conductive materials. The invention is not limited thereto. In addition, a material of the isolating conductor 140 is, for example, aluminum foil. In other embodiments, the material of the isolating conductor 140 may be other appropriate conductive materials. The invention is not limited thereto.

Figure 2:
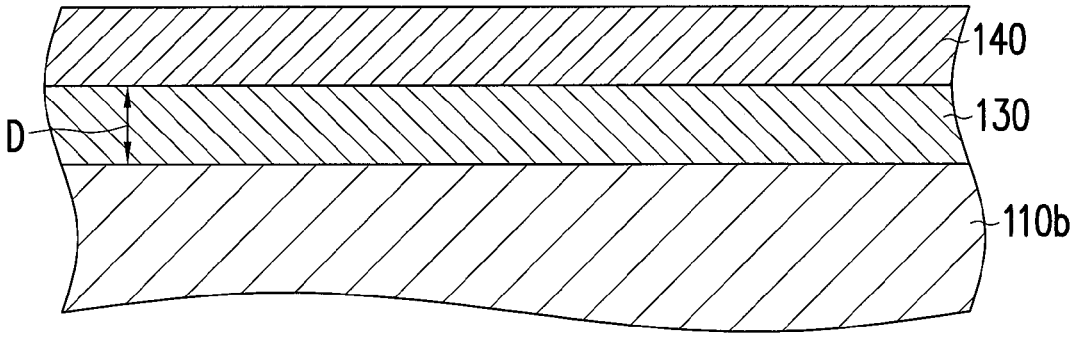
FIG. 2 is a local sectional view of the electronic device in FIG. 1.

FIG. 2 is a local sectional view of the electronic device in FIG. 1. Please refer to FIG. 2. The insulating layer 130 in the embodiment is located between the shell 110*b* and the isolating conductor 140 so that the shell 110*b* and the isolating conductor 140 have a distance D in between and are equivalent to a capacitor. Further, Mylar can be selected to be the insulating layer 130 so that the insulating layer 130 has a less thickness to narrow down the distance D, thereby increasing an equivalent capacitance value between the shell 110*b* and the isolating conductor 140. Under the circumstances where the equivalent capacitance value is greater, a resistance value in a region where the isolating conductor 140 is located can be effectively lowered. As a result, the signal from the first antenna 122 or the signal from the second antenna 124 is easy to be conducted to the isolating conductor 140 and the slot 142 thereon to ensure the signal from the first antenna 122 and the signal from the second antenna 124 do not interfere mutually with the conduction of the shell 110*b* and with a over-close distance between the two antennas.

In the embodiment, since the insulating layer 130 is disposed on the shell 110*b*, the isolating conductor 140 located where the shell 110*b* is located may not inter-conduct with the shell 110*b* via the block by the insulating layer 130 so that the isolating conductor 140 has a good signal isolating effect. In other words, with the disposition of the insulating layer 130, the insulating conductor 140 does not have to be disposed in a region outside the shell 110*b* (such as the shell 110*a*) so that a disposition space in the electronic device 100 can be spared.

In summary, an insulating layer of the invention is disposed on a shell and is located between a ground plane of a first antenna and a ground plane of a second antenna. Moreover, an isolating conductor is disposed on the insulating layer and has a slot. The slot can be designed to have an appropriate length so as to coincide with a resonate frequency of the first antenna and the second antenna. As a result, even if the shell serves as a mutual ground plane of the first antenna and the second antenna to conduct the first antenna and the second antenna, the signals of the first antenna and the second antenna are isolated from each other via the isolating conductor and the slot thereon and do not interfere mutually with the conduction of the shell, so that an antenna unit meets the need of high isolation. In addition, under the circumstances where the shell is an appearance part of the electronic device, the slot is formed in the isolating conductor instead of in the shell so as to avoid affecting an appearance of the electronic device with the disposition of slot and to avoid an inner space of the electronic device to be exposed by the slot. Besides, the shell and the isolating conductor are designed to have a narrower distance in between so that an equivalent capacitance value between the shell and the isolating conductor can be increased, thereby effectively decreasing a resistance value in a region where the isolating conductor is located. As a result, a signal from the first antenna or a signal from the second antenna is easy be conducted to the isolating conductor and the slot thereon to ensure the signals from the first antenna and the second antenna do not interfere mutually with to the conduction of the shell.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. An electronic device, comprising:

a shell, having a first region and a second region, wherein a material of the shell comprising a conductive material;

an antenna unit, disposed on the shell and comprising a first antenna and a second antenna, wherein the first antenna has a first radiating portion, a first feed portion and a first ground portion, the second antenna has a second radiating portion, a second feed portion and a second ground portion, the first feed portion is connected between the first radiating portion and the first ground portion, the second feed portion is connected between the second radiating portion and the second ground portion, and the first ground portion and the second ground portion are connected to the first region and the second region respectively such that the first antenna and the second antenna are grounded to a mutual ground plane of the shell;

an insulating layer, disposed on the mutual ground plane of the shell and located between the first region and-the second region; and an isolating conductor, disposed on the insulating layer and having a slot, wherein a length of the slot is 0.5 times or 0.25 times longer than a wavelength of the resonate frequency of the first antenna and the second antenna, and the isolating conductor does not inter-conduct with the shell.

2. The electronic device according to claim 1, wherein the first antenna and the second antenna have the same resonate frequency.

3. The electronic device according to claim 1, wherein a material of the insulating layer comprises plastic.

4. The electronic device according to claim 1, wherein the shell is an appearance part of the electronic device.

5. The electronic device according to claim 1, wherein the insulating layer is located between the shell and the isolating conductor so that the shell and the isolating conductor have a distance in between and are equivalent to a capacitor.

6. The electronic device according to claim 1, wherein the slot is in a bending shape.

7. The electronic device according to claim 1, wherein a material of the conductive material comprises metal or carbon fiber.

* * * * *